US011835200B2

(12) United States Patent
Lokhande et al.

(10) Patent No.: US 11,835,200 B2
(45) Date of Patent: Dec. 5, 2023

(54) LIGHT FIXTURE WITH BACKUP BATTERY

(71) Applicant: Eaton Intelligent Power Limited, Dublin (IE)

(72) Inventors: Prashant Lokhande, Lonavala (IN); Vinaya N. Kubsad, Pune (IN); Christopher Ring, Derry, NH (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 17/454,049

(22) Filed: Nov. 8, 2021

(65) Prior Publication Data

US 2022/0154898 A1 May 19, 2022

Related U.S. Application Data

(60) Provisional application No. 63/113,334, filed on Nov. 13, 2020.

(51) Int. Cl.

| | |
|---|---|
| ***F21S 9/02*** | (2006.01) |
| ***F21V 29/77*** | (2015.01) |
| ***F21V 17/10*** | (2006.01) |
| ***F21V 23/00*** | (2015.01) |

(52) U.S. Cl.

CPC ..... *F21S 9/02* (2013.01); *F21V 17/10* (2013.01); *F21V 23/007* (2013.01); *F21V 29/773* (2015.01)

(58) Field of Classification Search

CPC ..... F21S 9/02; F21S 9/024

See application file for complete search history.

(56) References Cited

U.S. PATENT DOCUMENTS

| | | | |
|---|---|---|---|
| 9,755,448 | B2 | 9/2017 | Shaw |
| 9,930,758 | B2 | 3/2018 | Jayawardena et al. |
| 10,260,722 | B2 | 4/2019 | Treible, Jr. et al. |
| 10,408,442 | B2 | 9/2019 | Treible, Jr. et al. |
| 10,443,832 | B2 | 10/2019 | Manahan et al. |
| 10,551,047 | B2 | 2/2020 | Treible, Jr. et al. |
| 10,655,833 | B2 | 5/2020 | Freer et al. |

(Continued)

FOREIGN PATENT DOCUMENTS

| | | |
|---|---|---|
| CN | 206 530 980 U | 9/2017 |
| CN | 107 289 406 A | 10/2017 |

(Continued)

OTHER PUBLICATIONS

English Machine Translation of CN207922021 provided by Espacenet (Year: 2017).*

(Continued)

*Primary Examiner* — Zheng Song
(74) *Attorney, Agent, or Firm* — Stinson LLP

(57) ABSTRACT

A light fixture includes a light housing defining an interior space. A light source is at least partially disposed in the interior space of the light housing. A driver housing is attached to the light housing and defines an interior space. A driver is disposed in the interior space of the driver housing for providing electricity to the light source. The driver is configured for connection to a main power source for energizing the light fixture. A battery is disposed in the interior space of the driver housing and is configured to provide backup power to the light fixture in the event of a loss of power from the main power source.

16 Claims, 10 Drawing Sheets

(56) References Cited

U.S. PATENT DOCUMENTS

| | | | | |
|---|---|---|---|---|
| 2004/0252489 | A1* | 12/2004 | Hagen | F21S 8/022 362/153.1 |
| 2005/0099804 | A1* | 5/2005 | Sharrah | F21V 23/0414 362/208 |
| 2012/0155077 | A1* | 6/2012 | Kim | F21V 23/02 362/235 |
| 2012/0212945 | A1* | 8/2012 | Frank | F21S 2/005 362/184 |
| 2016/0230973 | A1* | 8/2016 | Shaw | F21S 9/022 |
| 2017/0307197 | A1* | 10/2017 | Clark | H05B 45/30 |
| 2017/0343185 | A1* | 11/2017 | Fieberg | F21V 5/045 |
| 2018/0128436 | A1* | 5/2018 | Shaw | F21V 17/12 |
| 2018/0231189 | A1 | 8/2018 | Guo et al. | |
| 2018/0320882 | A1* | 11/2018 | Jenson | F21V 29/83 |
| 2019/0101257 | A1* | 4/2019 | Boulanger | F21V 23/007 |
| 2019/0203924 | A1* | 7/2019 | Devappa | F21V 29/508 |
| 2021/0310641 | A1* | 10/2021 | Grider | F21L 4/085 |

FOREIGN PATENT DOCUMENTS

| | | |
|---|---|---|
| CN | 207 922 021 U | 9/2018 |
| CN | 201 179 488 U | 3/2020 |
| DE | 20 2016 101832 U1 | 7/2017 |

OTHER PUBLICATIONS

European Extended Search Report for Application No. 21207068.4, dated Mar. 21, 2022, 10 pages Munich, Germany.

* cited by examiner

LIGHT FIXTURE WITH BACKUP BATTERY

CROSS-REFERENCE TO RELATED APPLICATION

This application claims priority to U.S. Provisional Patent Application Ser. No. 63/113,334, filed Nov. 13, 2020, and which is hereby incorporated by reference in its entirety.

FIELD

The present disclosure generally relates to light fixtures and enclosures for light fixtures.

BACKGROUND

Light fixtures are used in a variety of environments. Many of these light fixtures use advanced technology with a number of components. In lighting applications, such as hazardous environments (e.g., coal mines, petrochemical industries, etc.), reliability of the lighting system is vital. However, within these hazardous environments, power failure can be an issue. The characteristics (e.g., humidity, extreme temperatures, corrosive gas) of many environments, including but not limited to hazardous environments, can cause issues with the operability of one or more components of a light fixture. Additionally, outdoor electrical products can be in service for many years and are consistently exposed to extremely harsh environments, such as temperatures ranging from 0° C. to 50° C., with constant exposure to ultraviolet radiation, rain, salt, fog, ozone, thermal cycling, corrosive chemicals, and the like.

Reference is made to U.S. Pat. Nos. 10,408,442, 10,443,832, 10,260,722, 10,655,833, and 10,551,047 for further discussion of prior practice and improvements in the light fixture industry. These patents illustrate the improvements that have been manifested particularly with respect to light fixtures in hazardous locations.

SUMMARY

In one aspect, a light fixture generally comprises a light housing defining an interior space. A light source is at least partially disposed in the interior space of the light housing. A driver housing is attached to the light housing and defines an interior space. A driver is disposed in the interior space of the driver housing for providing electricity to the light source. The driver is configured for connection to a main power source for energizing the light fixture. A battery is disposed in the interior space of the driver housing and is configured to provide backup power to the light fixture in the event of a loss of power from the main power source.

In another aspect, an enclosure assembly generally comprises a driver housing defining an interior space. A driver is disposed in the interior space of the driver housing for providing electricity to an electrical component. A battery is disposed in the interior space of the driver housing and is configured to provide power to the electrical component. A separator plate is disposed in the interior space of the driver housing. The separator plate separates the interior space in the driver housing into an upper section and a lower section.

DETAILED DESCRIPTION

Figure 1:
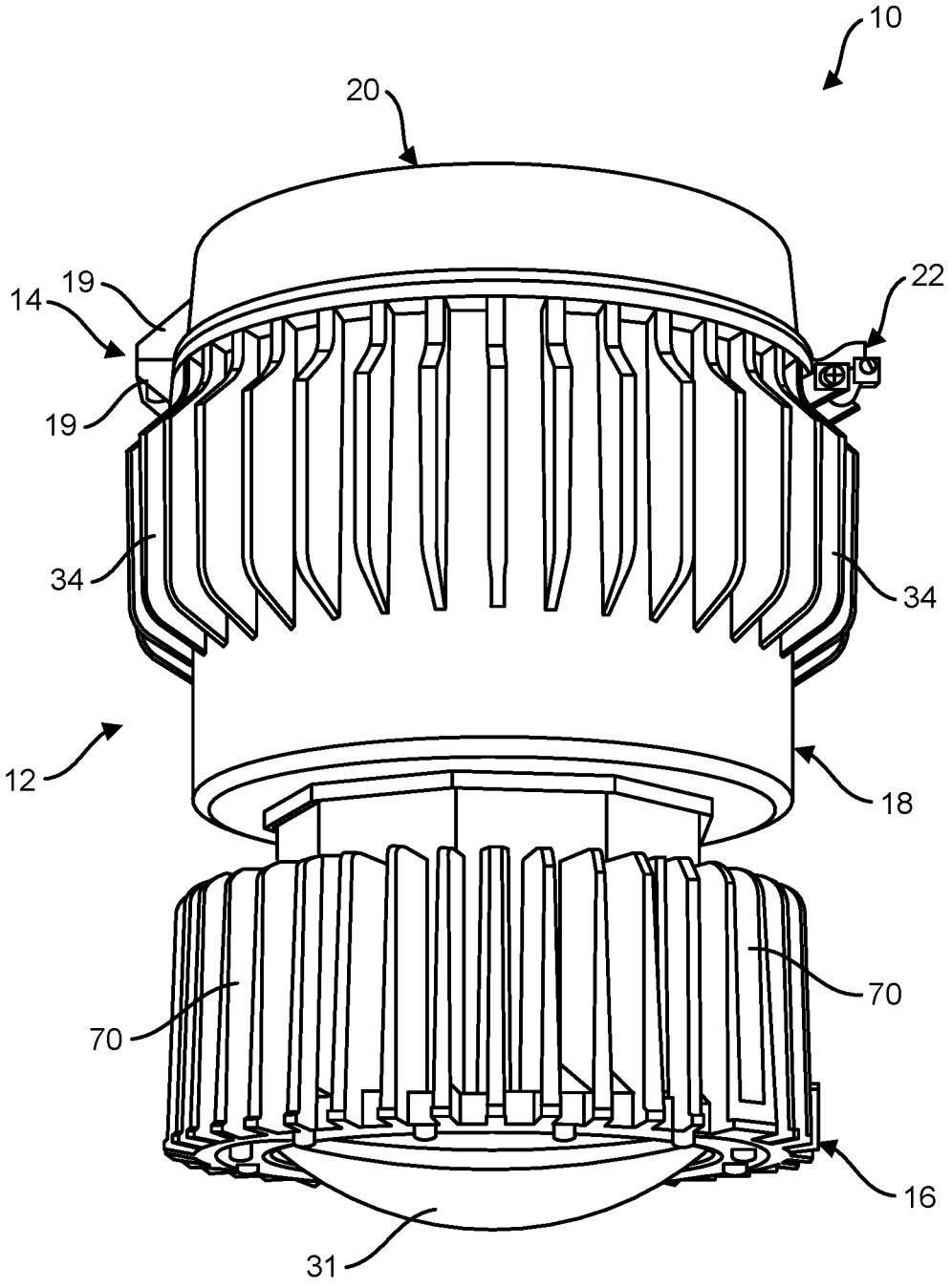
FIG. 1 is perspective of a light fixture.
Figure 2:
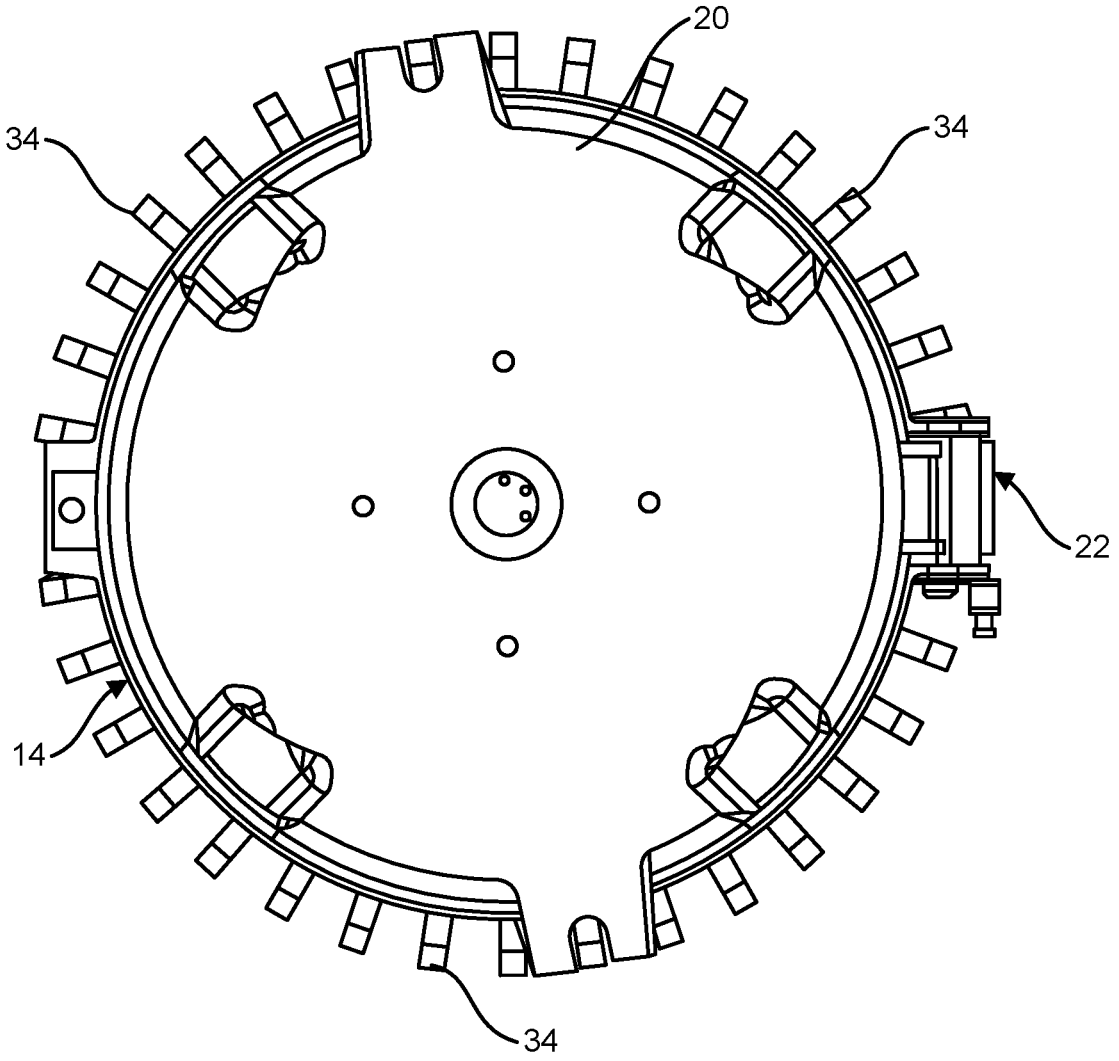
FIG. 2 is a top view of the light fixture.
Figure 3:
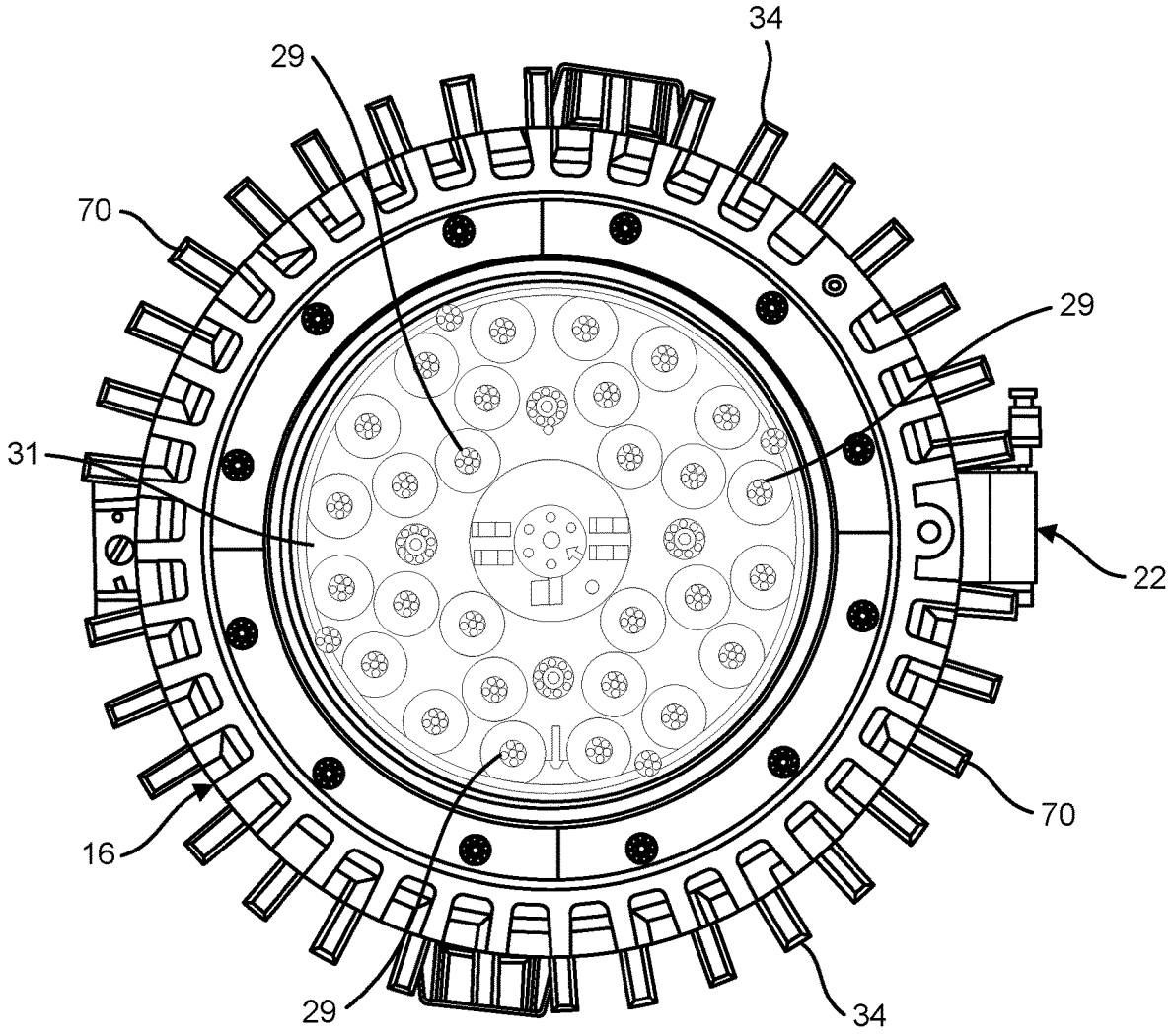
FIG. 3 is a bottom view of the light fixture.
Figure 4:
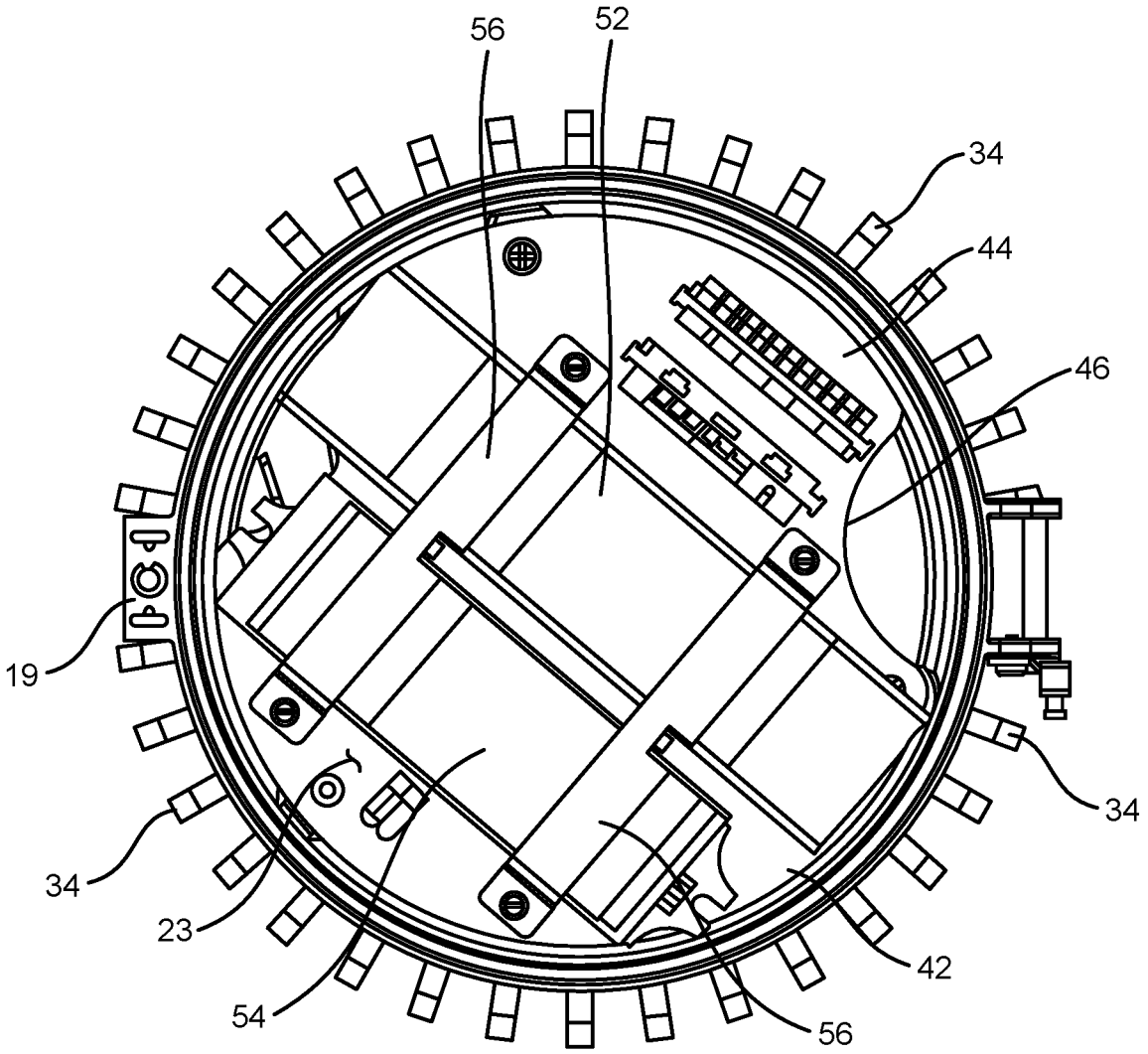
FIG. 4 is a top view of the light fixture with a top housing compartment removed to show internal detail of a driver compartment assembly.

Referring to FIGS. 1-3, a light fixture is generally indicated at 10. The light fixture comprises a housing 12 defining one or more interior spaces for enclosing the internal components of the fixture. In the illustrated embodiment, the housing 12 comprises a plurality of housing components suitably connected together. However, the housing 12 could comprise a single housing component. In some embodiments, the light fixture 10 can be used in a hazardous environment. In such a case, example embodiments can be located in any type of hazardous environment, including but not limited to an airplane hangar, a drilling rig (as for oil, gas, or water), a production rig (as for oil or gas), a refinery, a chemical plant, a power plant, a mining operation, a wastewater treatment facility, and a steel mill. A hazardous environment can include a classified location.

Hazardous locations may be defined by one or more of a number of authorities, including but not limited to the National Electric Code (e.g., Class 1, Division 2). For example, a Class 1 hazardous area under the National Electric Code is an area in which flammable gases or vapors may be present in the air in sufficient quantities to be explosive. Standards created and maintained by NEMA may be found at www.nema.org. In one or more example embodiments, the present enclosure is a Class 1, Division 1 or Class 2, Division 1 hazardous location enclosure.

As defined herein, an electrical enclosure is any type of cabinet or housing inside of which is disposed electrical, mechanical, electro-mechanical, and/or electronic equipment. Such equipment can include, but is not limited to, a controller (also called a control module), a hardware processor, a power supply (e.g., a battery, a driver, a ballast), a sensor module, a safety barrier, a sensor, sensor circuitry, a light source, electrical cables, and electrical conductors. Examples of an electrical enclosure can include, but are not limited to, a housing for a light fixture, a housing for a sensor device, an electrical connector, a junction box, a motor control center, a breaker box, an electrical housing, a conduit, a control panel, an indicating panel, and a control cabinet.

Referring to FIGS. 1-3, the housing 12 comprises a first housing section 14 and a second housing section 16 attached to the first housing section. The first housing section 14 is disposed on top of the second housing section 16 and includes a bottom housing portion 18 and a top housing portion 20 attached to the bottom housing portion. The first housing section 14 alone may be considered a housing or part of a housing whereby the bottom housing portion 18 and the top housing portion 20 comprise first and second housing sections, respectively. In one embodiment, the top housing portion 20 is hingedly attached to the bottom housing portion 18. For example, a pin connection 22 may hingedly attach the top housing portion 20 to the bottom housing portion 18. When the top housing portion 20 is pivoted to engage the bottom housing portion 18, mating locking formations 19 on the top and bottom housing portions 20, 18 facilitate locking the housing portions together. The top housing portion 20 may be constructed from any suitable material. In one embodiment, the top housing portion 20 is formed from metal such that the top housing portion may be characterized as a metal top hat. The first housing section 14 defines an interior space 23 configured for housing one or more components of the light fixture 10. In one embodiment, the first housing section 14 defines an interior space for housing an LED driver assembly 26 for controlling the operation of the light fixture 10 and providing electricity to light sources 29 (FIG. 3) of the light fixture housed in the second housing section 16. The driver assembly 26 is configured for connection to a main source of power for energizing the light fixture 10. In the illustrated embodiment, the driver assembly 26 comprises a pair of LED drivers. However, the driver assembly 26 could comprise a single LED driver or more than two LED drivers without departing from the scope of the disclosure.

Referring to FIGS. 4-7, the LED driver assembly 26 is housed within the bottom housing portion 18 of the first housing section 14. In the illustrated embodiment, the bottom housing portion 18 comprises a metal housing such that the metal bottom housing portion defines the outermost housing structure around the driver components. The metal bottom housing portion 18 draws heat from the interior of the first housing section 14 to the exterior of the first housing section to transfer the heat to the periphery of the housing 12. The bottom housing portion 18 includes a bottom wall 30 and a circumferentially extending side wall 32 projecting upward from the bottom wall. A height H of the bottom housing portion 18 extends from the bottom to the top of the bottom housing portion. In one embodiment, the height H is between about 7 and about 8 inches. In one embodiment, the height H is about 7.55 inches. The bottom housing portion 18 also has an internal diameter D of between about 8 and about 10 inches. In one embodiment, the internal diameter D is about 8.97 inches. The height H and diameter D of the bottom housing portion 18 are greater than in a standard housing in similar light fixtures. This configures the bottom housing portion 18 to accommodate additional internal components of the light fixture 10. However, the bottom housing portion 18 is configured to mate with the top housing portion 20 and the second housing section 16 which have conventional constructions. Thus, the additional internal components of the light fixture 10 do not necessitate further reconfiguring of the top housing portion 20 or second housing section 16. The bottom housing portion 18 may be broadly considered a driver housing.

Fins 34 (broadly, a first heat sink) may be disposed on or formed integrally with an exterior surface of the side wall 32 of the bottom housing portion 18. In the illustrated embodiment, the fins 34 are integrated with the side wall 32 of the bottom housing portion 18. The fins 34 are circumferentially spaced equidistantly around the perimeter of the bottom housing portion 18 and extend vertically generally from a top of the bottom housing portion toward a bottom of the bottom housing portion. The fins 34 do not extend all the way to the bottom of the bottom housing portion 18 such that a lower section of the side wall 32 is free of fins providing an area for placing indicia such as name plates or other markings. Additionally, the fins 34 are relatively thin providing substantial gaps between the fins. This reduction in material reduces that area in which dust and debris can collect on the bottom housing portion 18. In the illustrated embodiment, each fin 34 extends from a raised annular portion 36 at the top of the bottom housing portion 18 and has a generally trapezoidal shape. As shown, a first side edge 38 of the fin 34 is concave a slopes downward, and a second side edge 40 of the fin is generally straight. The shape of the first side edge 38 further reduces the available surface area for dust accumulation. However, the fins 34 could have other constructions without departing from the scope of the disclosure. Additionally, the heat sink fins 34 can be of any number and/or have any of a number of configurations. The fins 34 increase the surface area of the bottom housing portion 18, thereby increasing its thermal transfer efficiency.

Figure 5:
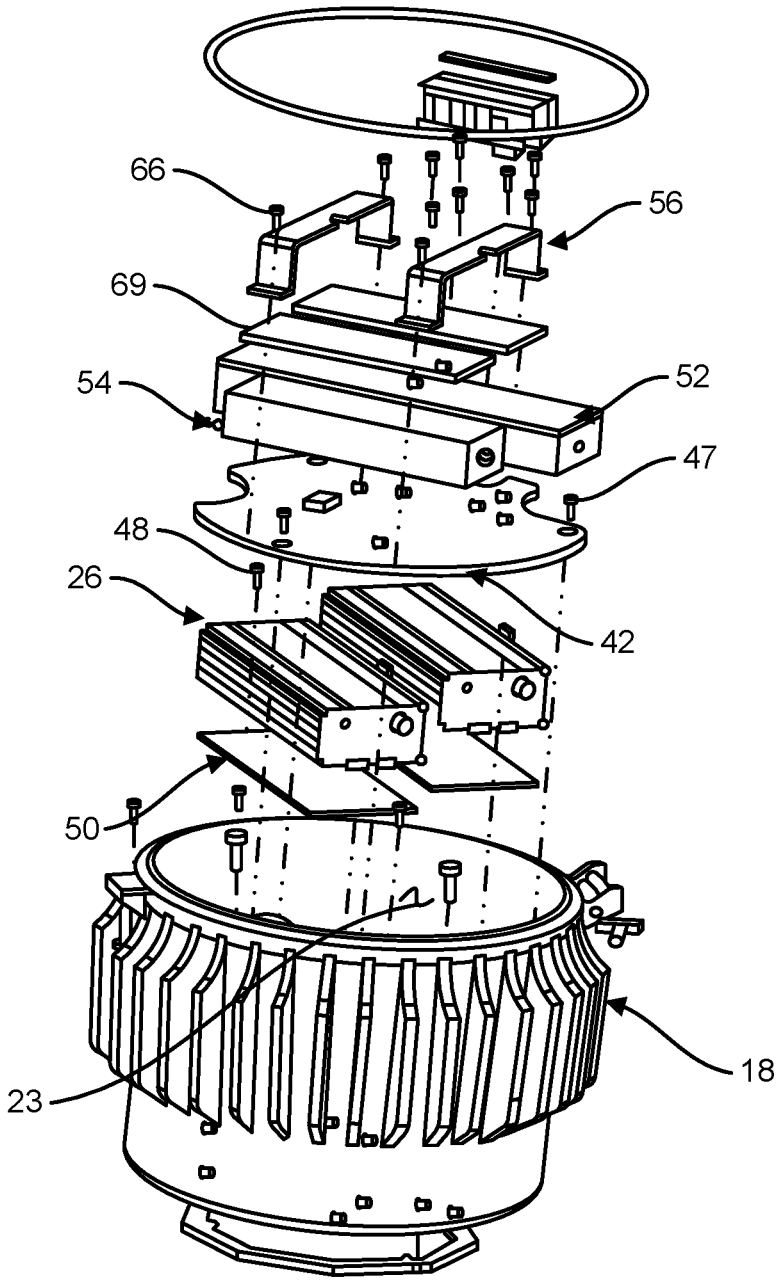
FIG. 5 is an exploded view of the driver compartment assembly.
Figure 6:
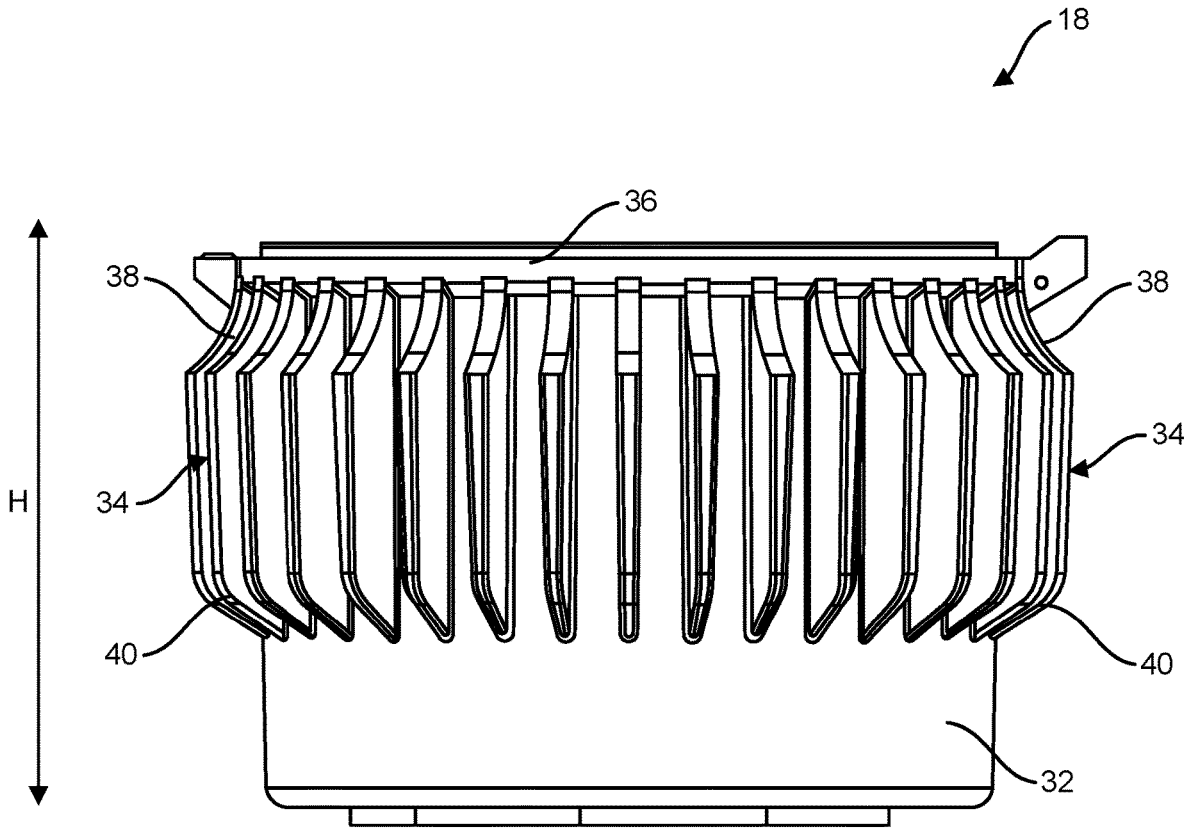
FIG. 6 is a side view of a driver housing of the driver compartment assembly.
Figure 7:
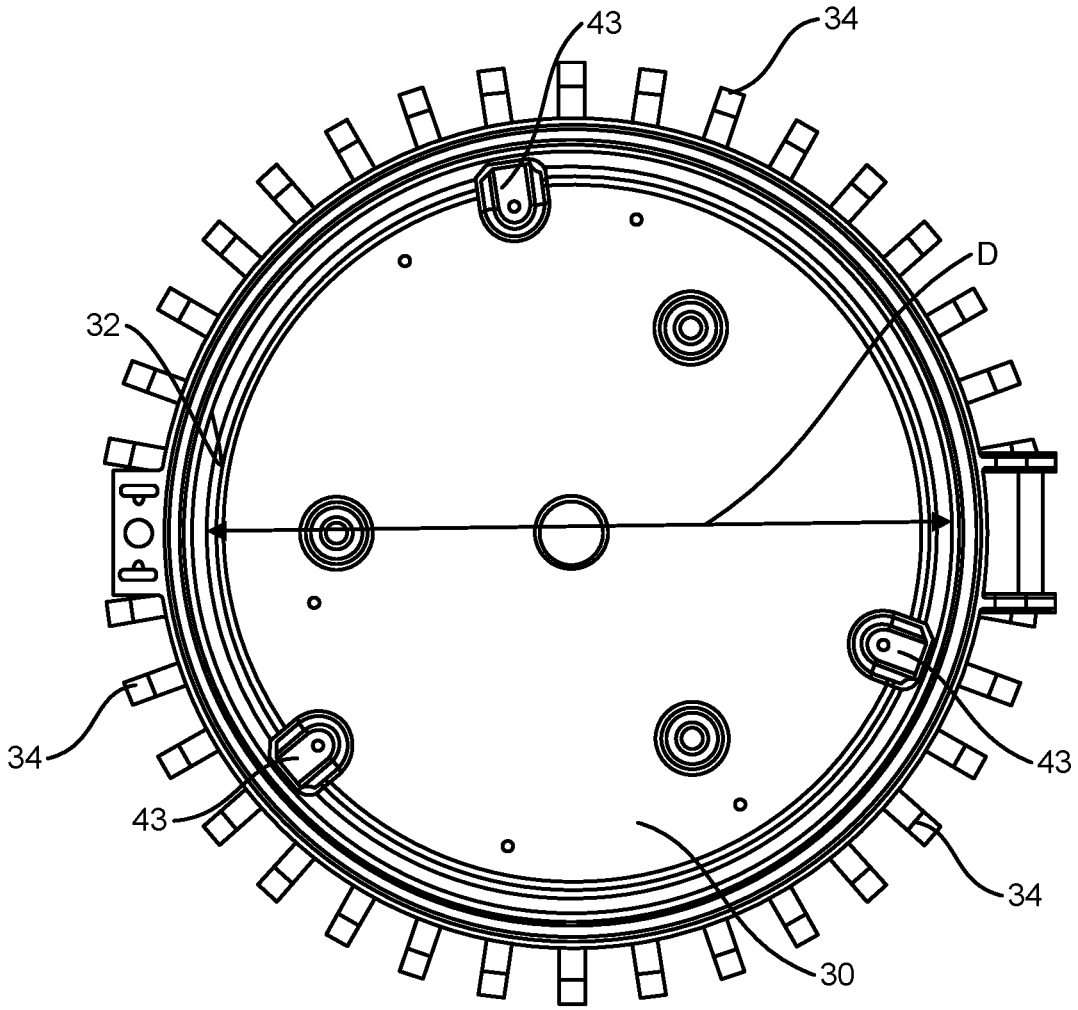
FIG. 7 is a top view of the driver housing.
Figure 8:
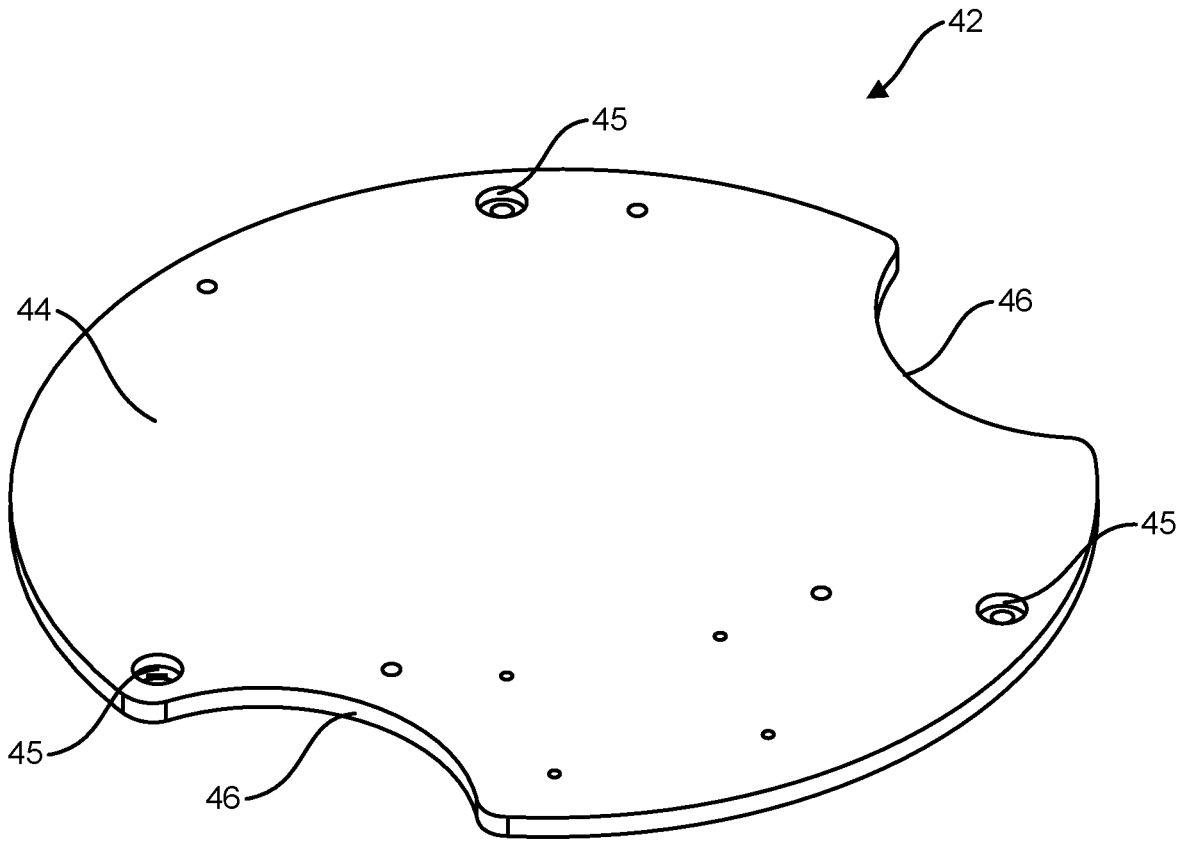
FIG. 8 is a perspective of a separator plate of the driver compartment assembly.
Figure 9:
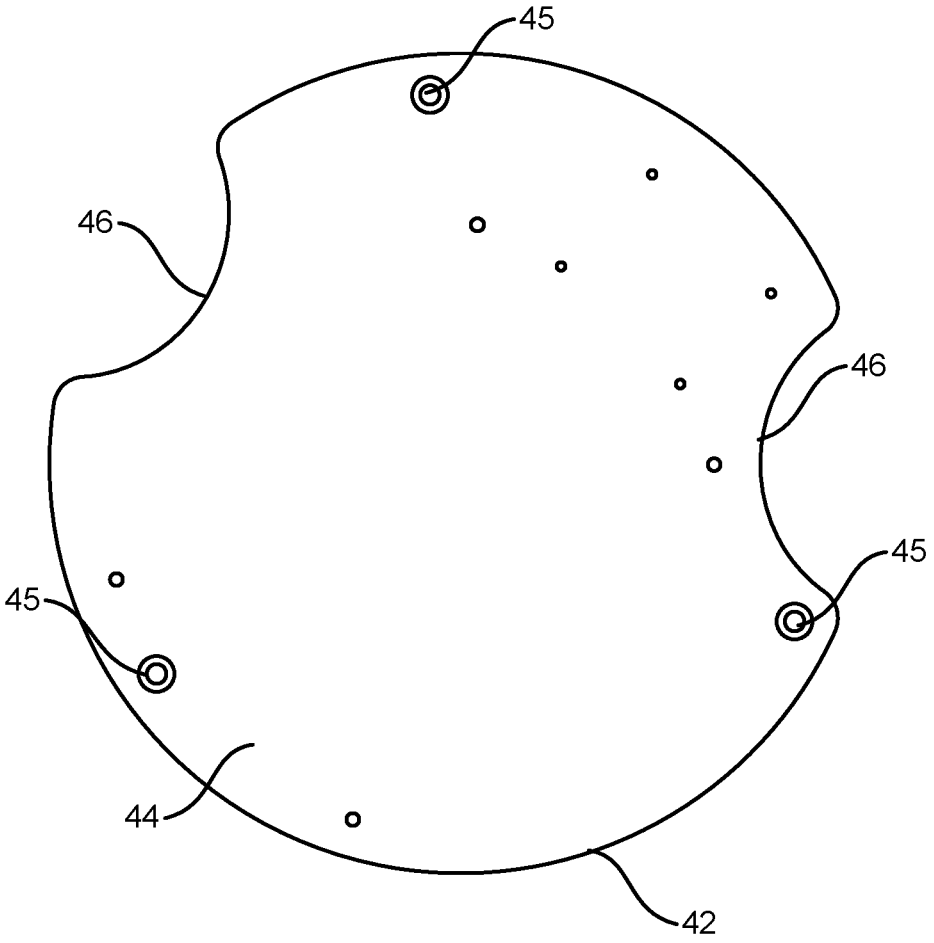
FIG. 9 is a top view of the separator plate.
Figure 10:
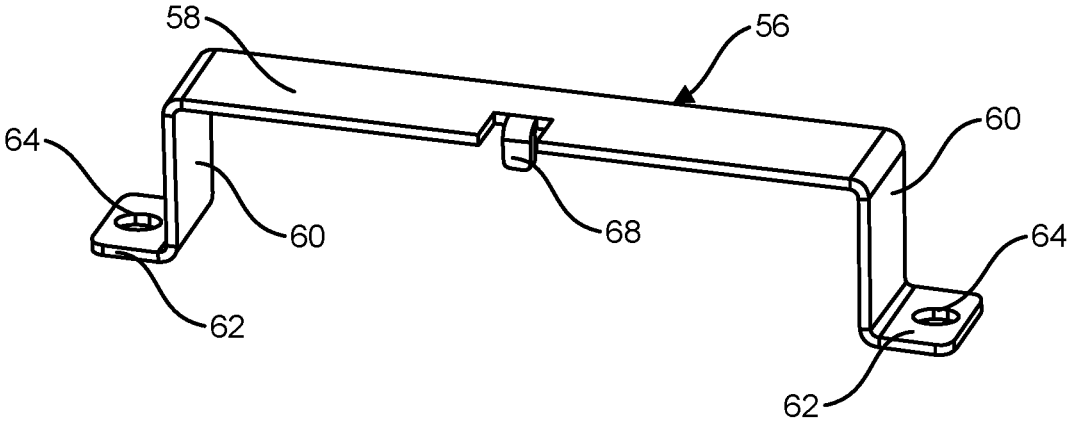
FIG. 10 is a perspective of a clamp of the driver compartment assembly.
Figure 11:
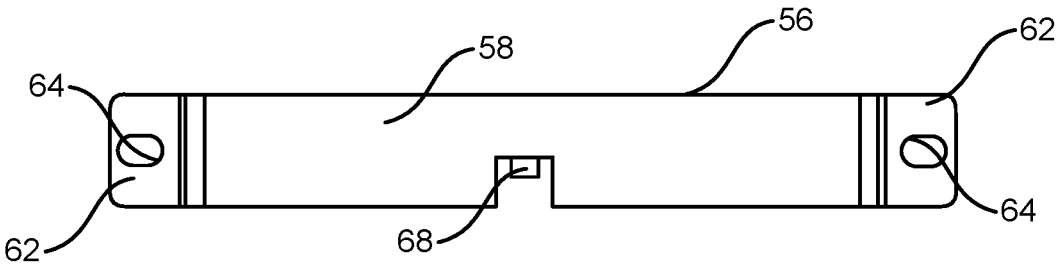
FIG. 11 is a top view of the clamp.
Figure 12:
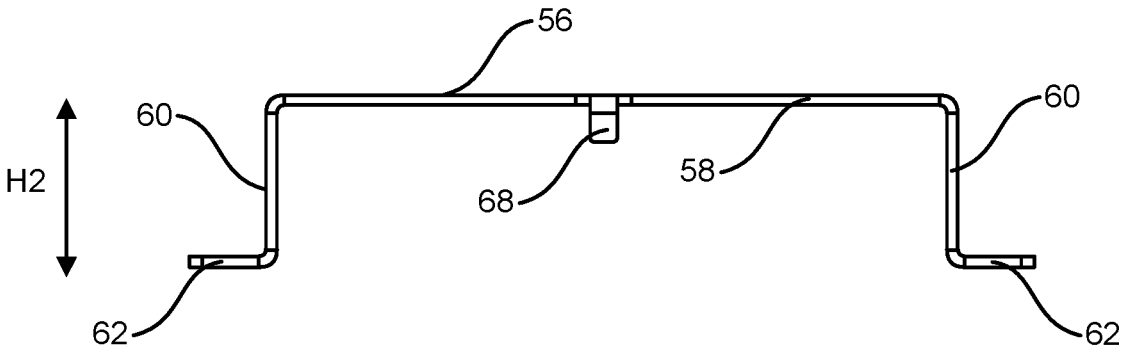
FIG. 12 is a side view of the clamp.

Referring to FIGS. 5, 8, and 9, a separator plate 42 is disposed within the interior space 23 of the bottom housing portion 18. The separator plate 42 comprises a generally disc shaped member 44 defining a pair of cut outs 46. The separator plate 42 is mounted on bosses 43 extending upward from the bottom wall 30 of the bottom housing portion 18 such that the separator plate is located above the bottom wall separating the interior space 23 into an upper section located above the separator plate and a lower section located below the spacer plate. The separator plate 42 defines fastener holes 45 for receiving fasteners 47 to mount the separator plate to the bosses 43. In the illustrated embodiment, there are three bosses 43. However, another number of bosses 43 could be used without departing from the scope of the disclosure. The cut outs 46 allow for wires to be routed between the upper and lower section in the bottom housing portion 18. In the illustrated embodiment, the cut outs 46 are generally crescent shaped. However, the cut outs 46 could have other shapes without departing from the scope of the disclosure. The separator plate 42 may be formed from any suitable material including steel, polymer, etc. As will be explained in greater detail below, the separator plate 42 acts as a heat barrier between the components in the upper and lower sections of the bottom housing portion 18. In particular, the separator plate 42 blocks the flow of heat from the lower section to the upper section of the bottom housing portion 18 to regulate the temperature within the upper section.

Referring to FIG. 5, the LED driver assembly 26 is disposed below the separator plate 42 in the lower section of the bottom housing portion 18. The LED driver assembly 26 is mounted to the bottom wall 30 by fasteners 48. Thermal pads 50 may be disposed between each of the LED driver assembly 26 and the bottom wall 30 of the bottom housing portion 18. The thermal pads 50 help with thermal management when there is not proper contact between the LED driver assembly 26 and the bottom wall 30 of the bottom housing portion 18.

Referring to FIGS. 4, 5, and 10-12, a battery 52 and battery driver 54 are disposed above the separator plate 42 in the upper section of the bottom housing portion 18. The separator plate 42 acts as a heat barrier between the lower section and the upper section to help reduce the temperature around the battery 52 and battery driver 54 to maintain the battery within a workable operating range. Clamps 56 secure the battery 52 and battery driver 54 to the separator plate 42. In the illustrated embodiment, two clamps 56 are shown whereby each clamp extends over both the battery 52 and the battery driver 54. However, a single clamp 56 or more than two clamps could be used without departing from the scope of the disclosure. Each clamp 56 comprises a cross bar 58 and arms 60 extending laterally from longitudinal ends of the cross bar. In the illustrated embodiment, the arms 62 extend orthogonally from the cross bar 58. However, the arms 62 could extend from the cross bar 58 at other angles without departing from the scope of the disclosure. A flange 62 extends laterally from each arm 60. In the illustrated embodiment, the flanges 62 extend orthogonally from the arms 62 and away from the cross bar 58. However, the flanges 62 could extend in other directions and at other angles without departing from the scope of the disclosure. Each flange 62 defines a fastener hole 64 for receiving a fastener 66 (e.g., screws) to secure the clamp 56 to the separator plate 42. A rib 68 extends laterally from the cross bar 58 generally at a midpoint along the length of the cross bar. The rib 68 extends between the battery 52 and battery driver 54 to space the battery from the battery driver. This provides a passage between the battery 52 and battery driver 54 for air flow which helps to improve the thermal efficiency of the light fixture 10. In particular, it provides a cooling effect to the battery 52 and battery driver 54 to maintain the battery components at acceptable temperatures. Additionally, each clamp 56 has a height H2 such that a positive clamping force will be applied to the battery 52 and battery driver 54 in most cases regardless of the dimensions of the battery and battery driver. This allows the fastener screws 66 to be placed in tension preventing the screws from loosening during use of the light fixture 10. In one embodiment, the height H2 of the clamps 56 is between about 1 and about 2 inches. In one embodiment, the height H2 of the clamps 56 is about 1.33 inches. Cushions 69 may also be disposed between each of the battery 52 and battery driver 54 and the cross bar 58 of the clamps 56. The height H2 provides a clearance for the cushions 69 to be disposed between the clamps 56 and the battery 52 and battery driver 54 to transfer the clamping force from the clamps to the battery 52 and battery driver 54. The cushions 69 account for any height differences between the battery 52 and battery driver 54 so that the clamps 56 can provide a sufficient compression force to both the battery and battery driver even if the components have different dimensions (e.g., heights). In one embodiment, the battery 52 and battery driver 54 comprise an emergency battery unit. As such, the battery 52 can supply power to the light fixture 10 in the result of a loss of power from the main power source.

The second housing section 16 is also configured to house one or more components of the light fixture 10. For example, one or more light sources 29 (FIG. 3) can be disposed on or within, at least in part, the second housing section 16 of the housing 12. A protective cover or lens 31 may be provided on the second housing section 16 to cover the light sources 29. The housing 12 may have one or more communication links (not shown) disposed between the housing sections 14, 16 to operatively connect the components within separate housing sections. Further, the housing sections 14, 16 can be designed to couple to each other in such a way that the entire housing 12 complies with applicable standards (e.g., hazardous location requirements). The second housing section 16 may be broadly considered a light housing.

Fins 70 (broadly, a second heat sink) can be disposed on and/or integrated with the second housing section 16. In the illustrated embodiment, the fins 70 are integrated with a portion of second housing section 16 of the housing 12. The fins 70 increase the surface area of the second housing section, thereby increasing its thermal transfer efficiency. The heat sink fins 70 can be of any number and/or have any of a number of configurations. In the illustrated embodiment, the heat sink fins 70 are vertically-oriented protrusions that extend outward on the second housing section 16 of the housing 12 and are spaced substantially equidistantly around the outer perimeter of the second housing section. The heat sink fins 70 could have other configurations without departing from the scope of the disclosure.

The overall construction of the light fixture 10 is configured to withstand the environmental conditions and physical demands of hazardous environments. In particular, the thermal endurance of the light fixture 10 ranges from about 0° C. to about 50° C. Thus, the light fixture 10 is able to keep the critical components below a temperature of 100° C. when the fixture is maintained within an environment of 50° C. In particular, the fixture 10 is able to keep the LED driver 26, battery driver 54, and battery 52 within a margin of 10° C. with respect to the ambient environment. This allows the battery 52 to be operated within an internal fixture temperature of about 55° C. while the light fixture 10 is disposed in ambient environment of about 45° C. The battery 52 also equips the light fixture 10 with a backup power source in the event of a loss of power to the light fixture from the main power source. In one embodiment, the battery 52 is configured to power the light fixture 10 to provide greater than 1000 lumen for over 90 minutes. The battery 52 may also be configured to provide a greater or lesser amount of power to the light fixture 10 without departing from the scope of the disclosure.

When introducing elements of the present disclosure or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the disclosure are achieved and other advantageous results attained.

As various changes could be made in the compositions without departing from the scope of the disclosure, it is intended that all matter contained in the above description shall be interpreted as illustrative and not in a limiting sense.

The invention claimed is:

1. A light fixture comprising:

a light housing defining an interior space;

a light source at least partially disposed in the interior space of the light housing;

a driver housing attached to the light housing and defining an interior space;

a driver disposed in the interior space of the driver housing for providing electricity to the light source, the driver being configured for connection to a main power source for energizing the light fixture;

a battery disposed in the interior space of the driver housing and configured to provide backup power to the light fixture in the event of a loss of power from the main power source;

a separator plate disposed in the interior space of the driver housing, the separator plate separating the interior space in the driver housing into an upper section and a lower section and acting as a heat barrier between components in the upper and lower sections;

a battery driver in the upper section; and a single clamp securing the battery and battery driver to the separator plate.

2. The light fixture of claim 1, further comprising a heat sink in thermal communication with the light source.

3. The light fixture of claim 2, wherein the heat sink comprises a plurality of fins formed on the driver housing.

4. The light fixture of claim 3, wherein the fins extend only partly along a height of the driver housing.

5. The light fixture of claim 1, wherein the driver is disposed in the lower section and the battery is disposed in the upper section.

6. The light fixture of claim 1, further comprising a cushion disposed between the clamp and at least one of the battery and battery driver.

7. The light fixture of claim 1, wherein the battery driver is configured for controlling operation of one or more electrical components of the light fixture.

8. The light fixture of claim 1, wherein the separator plate has a cutout along an outer peripheral edge of the separator plate for permitting wires to extend past the separator plate.

9. The light fixture of claim 1, wherein the fixture is a hazardous location enclosure.

10. The light fixture of claim 1, wherein the separator plate is formed from at least one of steel and plastic.

11. An enclosure assembly comprising:

a driver housing defining an interior space;

a driver disposed in the interior space of the driver housing for providing electricity to an electrical component;

a battery disposed in the interior space of the driver housing and configured to provide power to the electrical component;

a separator plate disposed in the interior space of the driver housing, the separator plate separating the interior space in the driver housing into an upper section and a lower section and acting as a heat barrier between components in the upper and lower sections;

a battery driver in the upper section; and a single clamp securing the battery and battery driver to the separator plate.

12. The enclosure assembly of claim 11, wherein the driver is disposed in the lower section and the battery is disposed in the upper section.

13. The enclosure assembly of claim 11, wherein the separator plate provides a thermal barrier between the upper and lower sections.

14. The enclosure assembly of claim 11, wherein the separator plate has a cutout along an outer peripheral edge of the separator plate for permitting wires to extend past the separator plate.

15. The enclosure assembly of claim 11 wherein the assembly is a light fixture.

16. The enclosure assembly of claim 11, wherein the assembly is a hazardous location enclosure.

* * * * *